US007377797B2

(12) United States Patent
Tsai

(10) Patent No.: US 7,377,797 B2
(45) Date of Patent: May 27, 2008

(54) CARD-IN/OUT DEVICE FOR AN ELECTRICAL CONNECTOR

(76) Inventor: Chou Hsuan Tsai, 15F,No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/336,512

(22) Filed: Jan. 20, 2006

(65) Prior Publication Data

US 2006/0166532 A1 Jul. 27, 2006

(51) Int. Cl.
*H01R 13/62* (2006.01)

(52) U.S. Cl. ..... 439/159; 439/630

(58) Field of Classification Search ..... 439/159, 439/630, 350, 160, 155, 141
See application file for complete search history.

(56) References Cited

U.S. PATENT DOCUMENTS 6,835,077 B2 * 12/2004 Ikeda et al. ..... 439/159
2003/0119350 A1 * 6/2003 Chen ..... 439/159
2004/0127079 A1 * 7/2004 Nagata ..... 439/159

* cited by examiner

*Primary Examiner*—Edwin A. Leon
(74) *Attorney, Agent, or Firm*—Pro-Techtor Int'l Services

(57) ABSTRACT

A card-in/out device for an electrical connector having a base composed of a bottom seat and an upper cover covering over the bottom seat. The device includes a sliding slot structure, a pushing piece and an elastic member. The sliding slot structure disposed in the base has a circulation path formed with a concave first positioning point and an initial second positioning point, and a bottom surface formed with one-way stoppers such that a one-way circulation from the second positioning point to the first positioning point and then the second positioning point is formed. The pushing piece engaged with an inner surface of the upper cover may slide back and forth, and has a push portion to be pushed by an inserted electrical element, and a guiding rod fit into the sliding slot structure. The elastic member provides a force for moving the pushing piece back to an original position.

8 Claims, 12 Drawing Sheets

CARD-IN/OUT DEVICE FOR AN ELECTRICAL CONNECTOR

BACKGROUND OF THE INVENTION

1. Field of the Invention

The invention relates to an electrical connector, and more particularly to a card-in/out device of an electrical connector.

2. Description of the Related Art

A card-in/out device capable of hiding and positioning an inserted card and exposing an ejected card has been widely used in electrical products and computer peripheral products. The card may be, for example, a multimedia storage card or a memory card. The available memory cards for computers have several specifications and include a secure digital card (SDC), a multimedia card (MMC), a smart media card (SMC), a memory stick card (MSC), an XD-picture card (XDC), and the like.

The connector, which is to be connected to the inserted memory card and capable of hiding and positioning the inserted memory card and exposing the ejected memory card, is provided with a card-in/out device, as shown in FIGS. 1 and 2. The connector includes a base 10, terminals 25, a pushing piece 20, a guiding rod 26 and a spring 28.

The base 10 includes a bottom seat 11 and an upper cover 19 covering over the bottom seat 11. As shown in FIG. 3, the bottom seat 11 is made of plastic injection molding and is formed with a receiving slot 18 for receiving one memory card with a variable specification. One side of the receiving slot 18 is one-piece molded to form a heart-like sliding slot 12. One end of the slot 12 is formed with a starting point 13, and the other end of the slot is formed with a stroke point 14, a middle concave positioning point 15 and a card-out starting point 16. The sliding slot 12 is formed with several sloped blocks 7, as illustrated by hatched portions. Thus, a one-way circulation path from the starting point 13 to the stroke point 14, the positioning point 15, the card-out starting point 16 and the starting point 13 is created.

The terminals 25 are arranged in several rows and disposed on the bottom seat 11.

The pushing piece 20 having an inverse U-shape includes two sides pushing against two sides of the receiving slot 18 on the bottom seat 11. A connection hole 21 is formed at a front end of one side of the pushing piece 20.

Two ends of the guiding rod 26 are formed with longitudinal hooks 27 for hooking the connection hole 21 of the pushing piece 20 and the sliding slot 12 of the bottom seat 11, respectively.

The spring 28, which is disposed between the pushing piece 20 and a rear end of the bottom seat 11, provides an elastic force for moving the pushing piece 20, which moves toward the inside of the base 10, back to the original position.

According to the above-mentioned structure, the pushing piece 20 pushed by the inserted memory card drives the guiding rod 26 to slide in the sliding slot 12. Because the sliding slot 12 has a: one-way circulation path, the guiding rod 26 is pushed from the starting point 13 to the stroke point 14 and then pulled back to the positioning point 15 and positioned at the positioning point 15 by the elastic force of the spring when the memory card is inserted. When the card is ejected, the memory card is also pushed, and the guiding rod 26 is pushed from the positioning point 15 to the card-out starting point 16 and then pulled back to the starting point 13 by the elastic force of the spring. Thus, the card in/out function can be achieved.

The conventional structure has the following drawbacks.

1. The pushing piece 20 is formed by way of plastic injection molding, and the intensity of the plastic material is poor and the piece 20 tends to break by an external force.

2. The pushing piece 20 cannot be in forced sliding contact with the base. In order to make the pushing piece 20 be assembled in the base stably, the pushing piece 20 must have an inverse U-shape such that the piece 20 can be stably placed on the bottom seat 11 and then pressed by the upper cover for positioning. However, the inverse U-shape of the pushing piece tends to waste a large amount of material and the plastic material is brittle and weak. So, the pushing piece 20 tends to break more easily.

3. The pushing piece 20 is positioned in the bottom seat 11. If the bottom seat 11 is divided into multiple sub-seats floating over the upper cover, the pushing piece cannot be positioned over the sub-seats.

4. The pushing piece and the spring is disposed and assembled on the bottom seat 11 and then the upper cover covers the pushing piece and the spring for positioning. So, the card-in/out effect of the product cannot be tested until the overall product has been assembled. If the product test fails, the product has to be disassembled for reconstruction or to be throw away.

SUMMARY OF THE INVENTION

It is therefore an object of the invention to provide a card-in/out device for an electrical connector, in which a pushing piece may be movably engaged with and in sliding contact with an upper cover such that a stable positioning effect can be obtained.

Another object of the invention is to provide a pushing piece of an electrical connector, which is formed by bending a metal plate and is good in the structural intensity and may be easily manufactured.

Still another object of the invention is to provide a card-in/out device for an electrical connector, wherein several members are assembled and positioned in the upper cover, such that a complete card-in/out mechanism is formed without the need of being assembled with the bottom seat. The card-in/out mechanism may be tested in the semi-facture phase, which is advantageous to the production of the product.

Yet still another object of the invention is to provide a card-in/out device of an electrical connector, wherein the sliding slot structure and the pushing piece are formed by pressing and bending a metal plate and thus have good structural intensity and smaller areas than those formed by way of plastic injection molding. Thus, the product may be miniaturized.

The invention achieves the above-identified object by providing a card-in/out device for an electrical connector. The electrical connector has a base composed of a bottom seat and an upper cover covering over the bottom seat. The card-in/out device includes a sliding slot structure, a pushing piece and an elastic member. The sliding slot structure is disposed in the base and has a circulation path. One end of the circulation path is formed with a concave first positioning point, and the other end of the circulation path is formed with an initial second positioning point. A bottom surface of the sliding slot structure is formed with a plurality of one-way stoppers such that a one-way circulation from the second positioning point to the first positioning point and then to the second positioning point is formed. The pushing piece is engaged with an inner surface of the upper cover, may slide back and forth relative to the upper cover, and has at least one push portion and a guiding rod. The guiding rod is fit into the sliding slot structure, and the at least one push portion may be pushed by an inserted electrical element. The elastic member provides an elastic force for moving the pushing piece, which is moved from an original position into the base, back to the original position.

The sliding slot structure may be a metal sliding slot structure integrally formed by pressing and bending a metal plate.

The pushing piece may be formed by pressing and bending a metal plate and include: a longitudinal plate extending in an inserting direction of the base and comprises at least one push portion which may be pushed in the inserting direction; a horizontal plate integrally connected with the longitudinal plate, the horizontal plate being bent into a horizontal state from a top of the longitudinal plate toward an outside; and a guiding rod having one end connected to the horizontal plate or the longitudinal plate, and the other end longitudinally engaged with the sliding slot structure of the base such that the guiding rod can slide back and forth.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
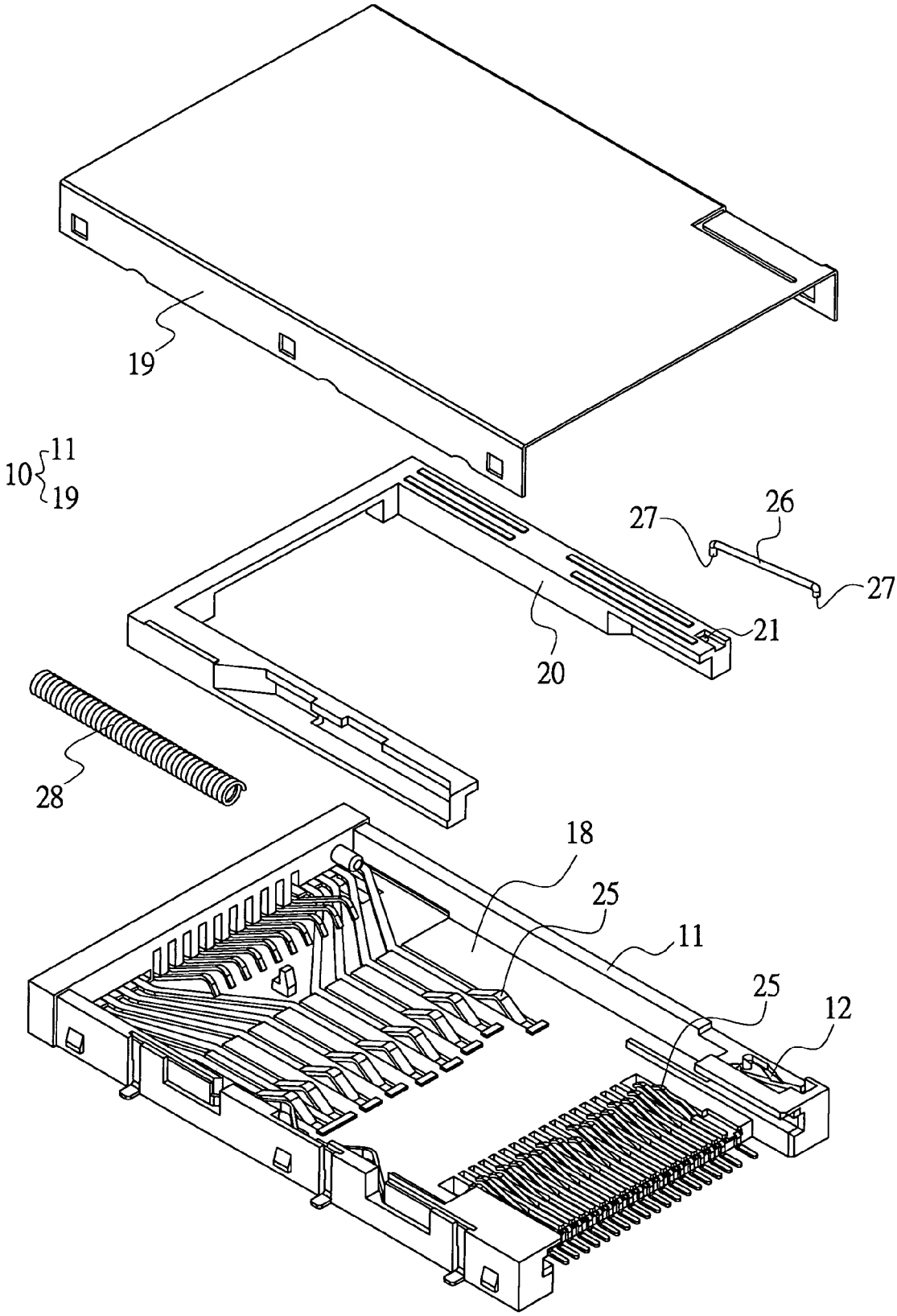
FIG. 1 (PRIOR ART)
FIG. 1 is a pictorially exploded view showing a conventional electrical connector.
Figure 2:
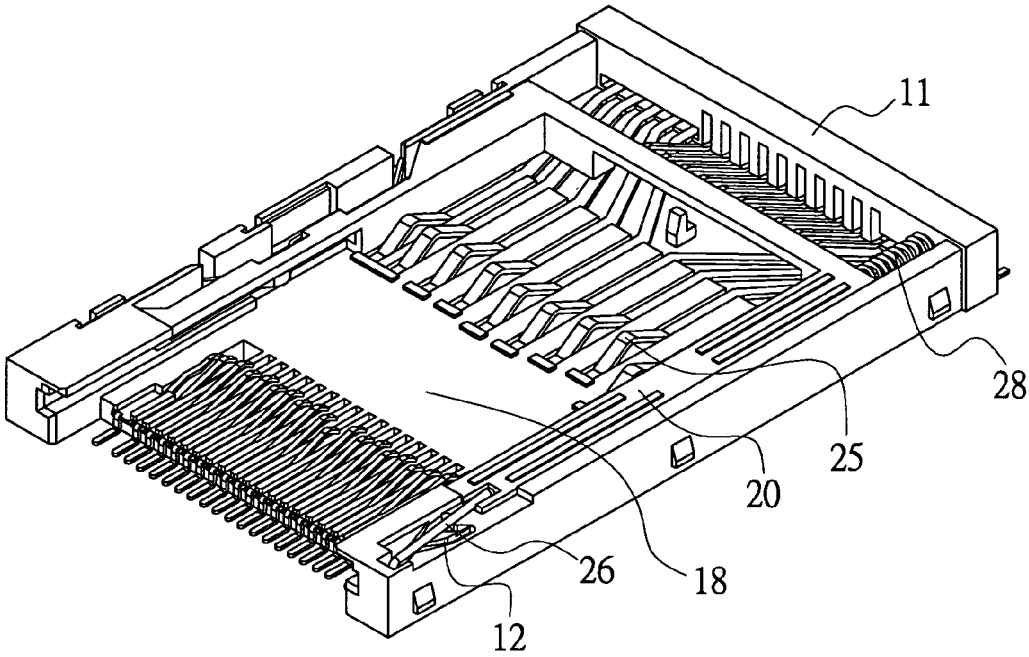
FIG. 2 (PRIOR ART)
FIG. 2 is a pictorially assembled view showing the conventional electrical connector with the upper cover being removed.
Figure 3:
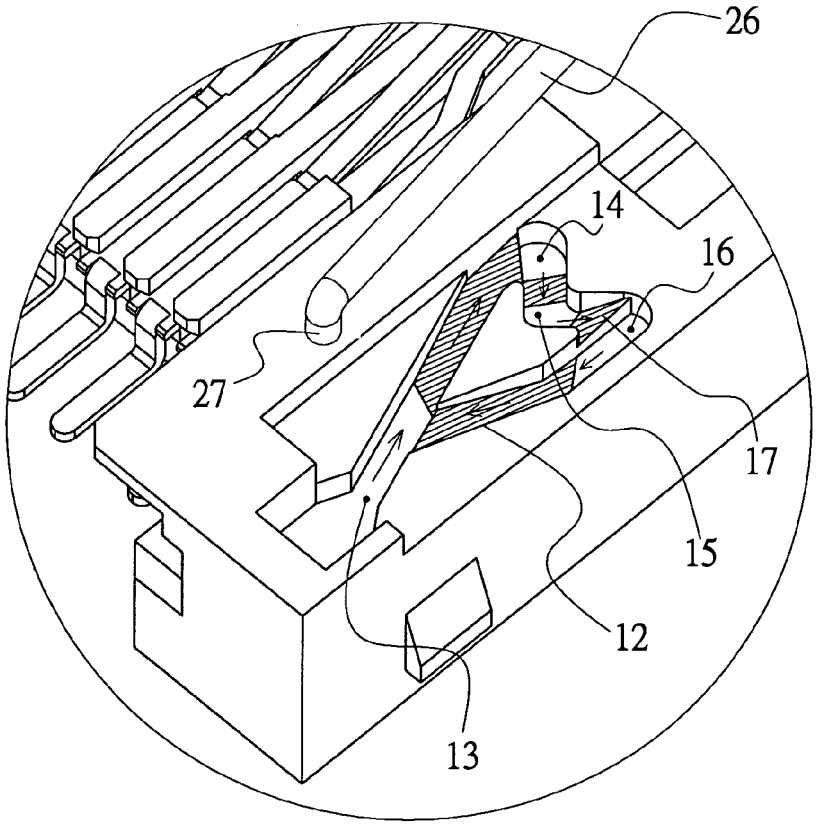
FIG. 3 (PRIOR ART)
FIG. 3 is a pictorial view showing a sliding slot structure of the conventional electrical connector.
Figure 4:
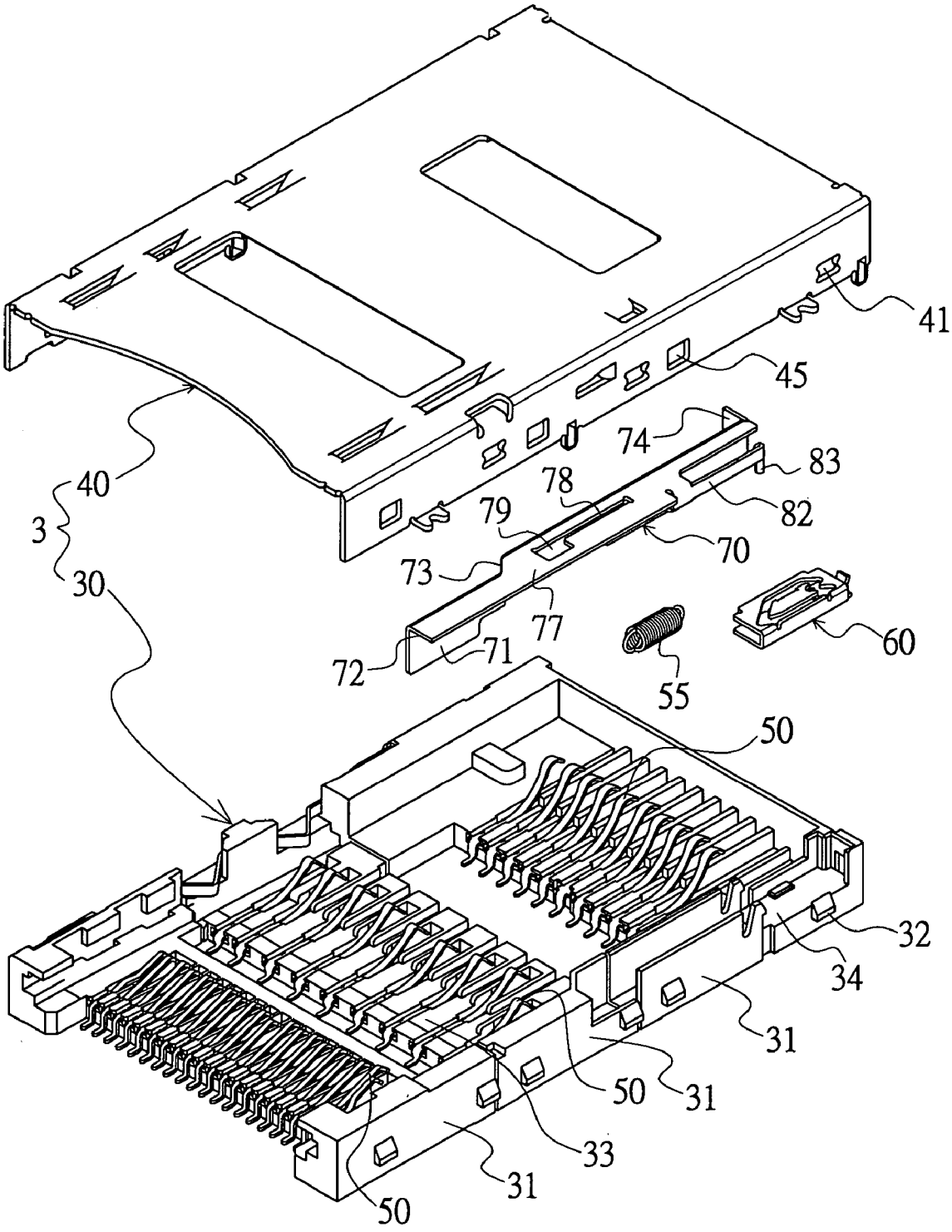
FIG. 4 is a pictorially exploded view showing an electrical connector according to a first embodiment of the invention.
Figure 5:
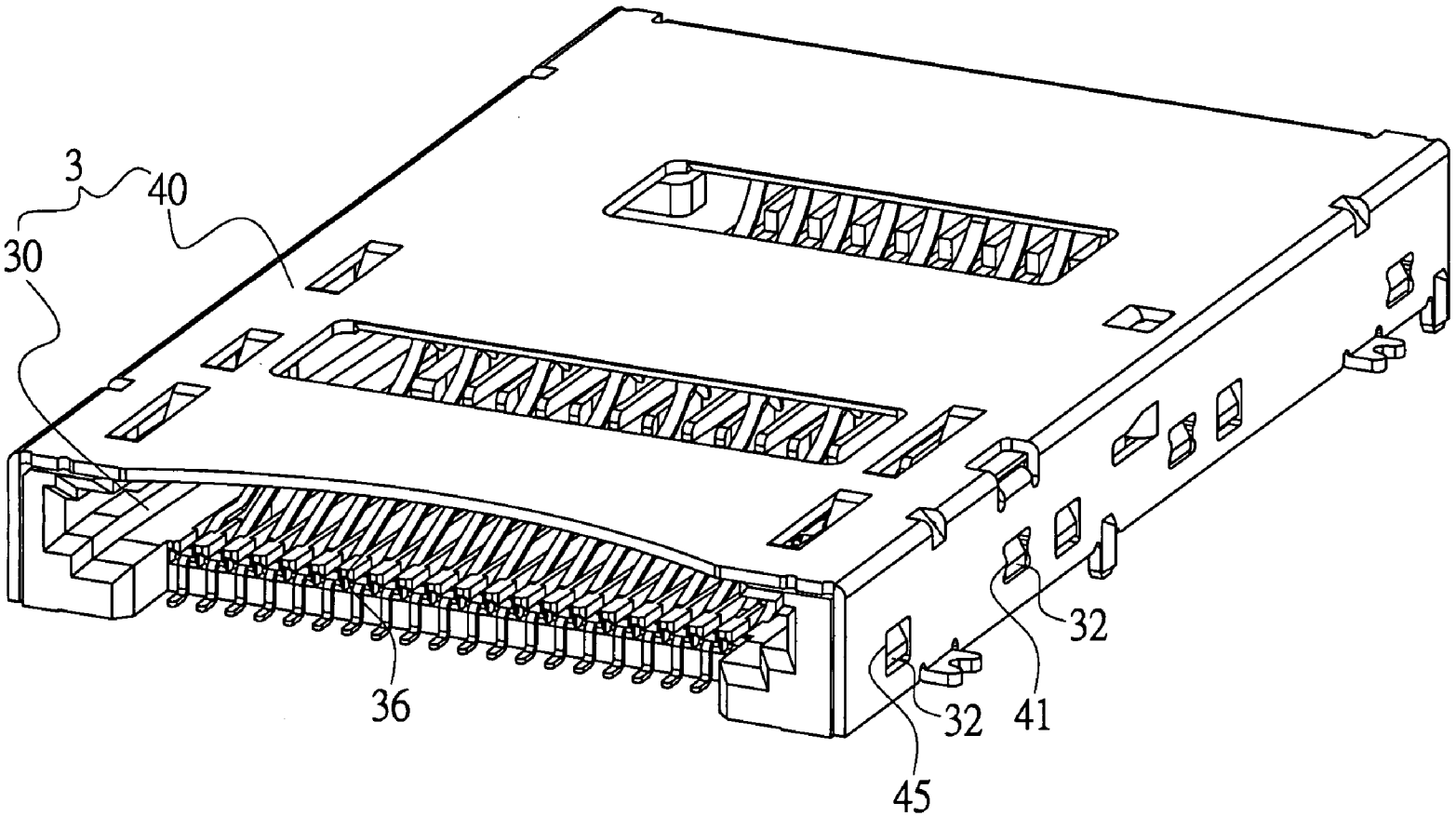
FIG. 5 is a pictorially assembled view showing the electrical connector according to the first embodiment of the invention.
Figure 6:
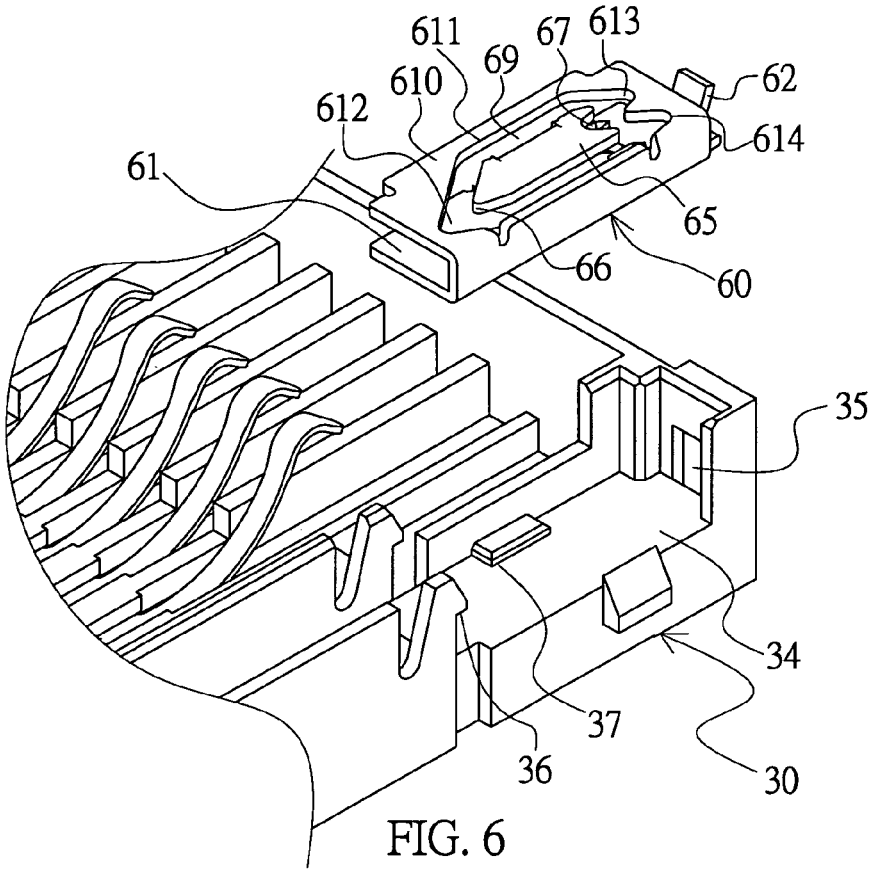
FIG. 6 is a pictorially exploded view showing a metal sliding slot structure and a disposing slot according to the first embodiment of the invention.
Figure 7:
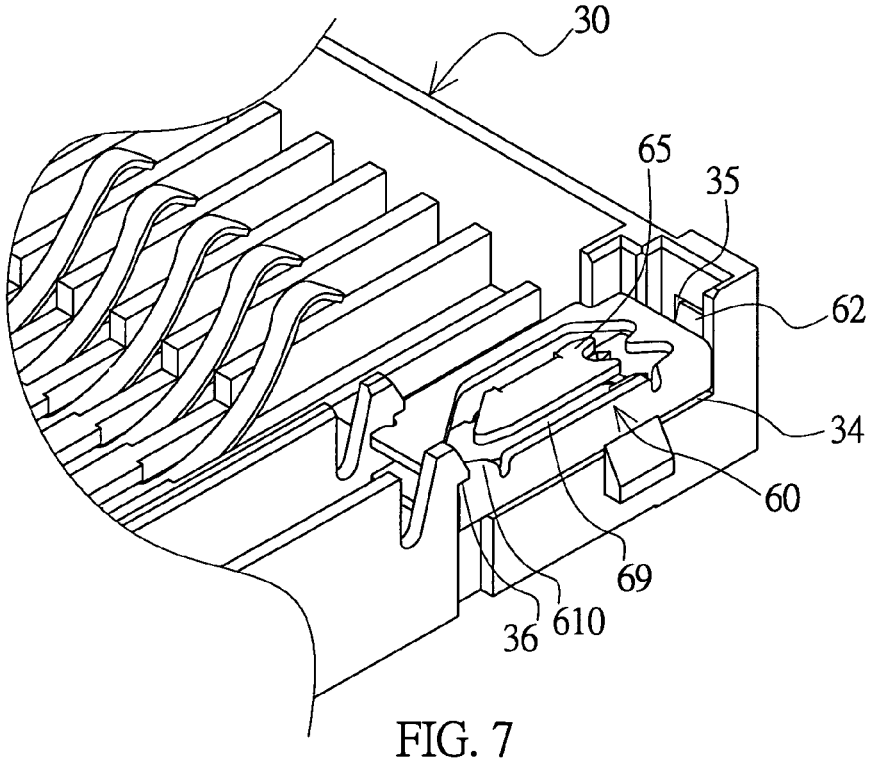
FIG. 7 is a pictorially assembled view showing the, metal sliding slot structure and the disposing slot according to the first embodiment of the invention.
Figure 8:
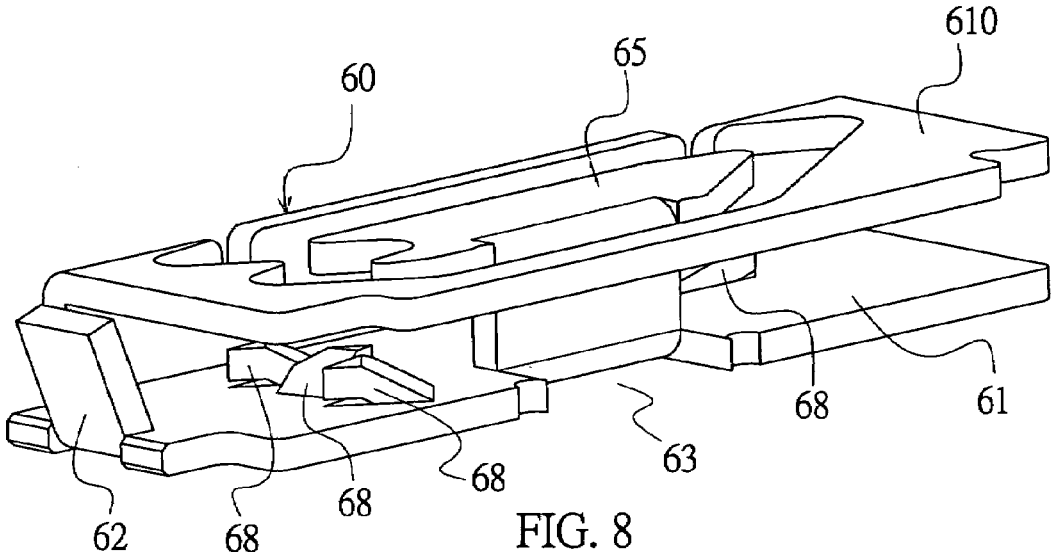
FIG. 8 is a pictorial view showing the metal sliding slot structure according to the first embodiment of the invention.

Referring to FIGS. 4 and 5, the electrical connector of this embodiment is a memory card connector, into which various memory cards with different specifications may be individually inserted for connection. The connector includes a base 3, terminals 50, a metal sliding slot structure 60, a pushing piece 70 and a spring 55.

Figure 10:
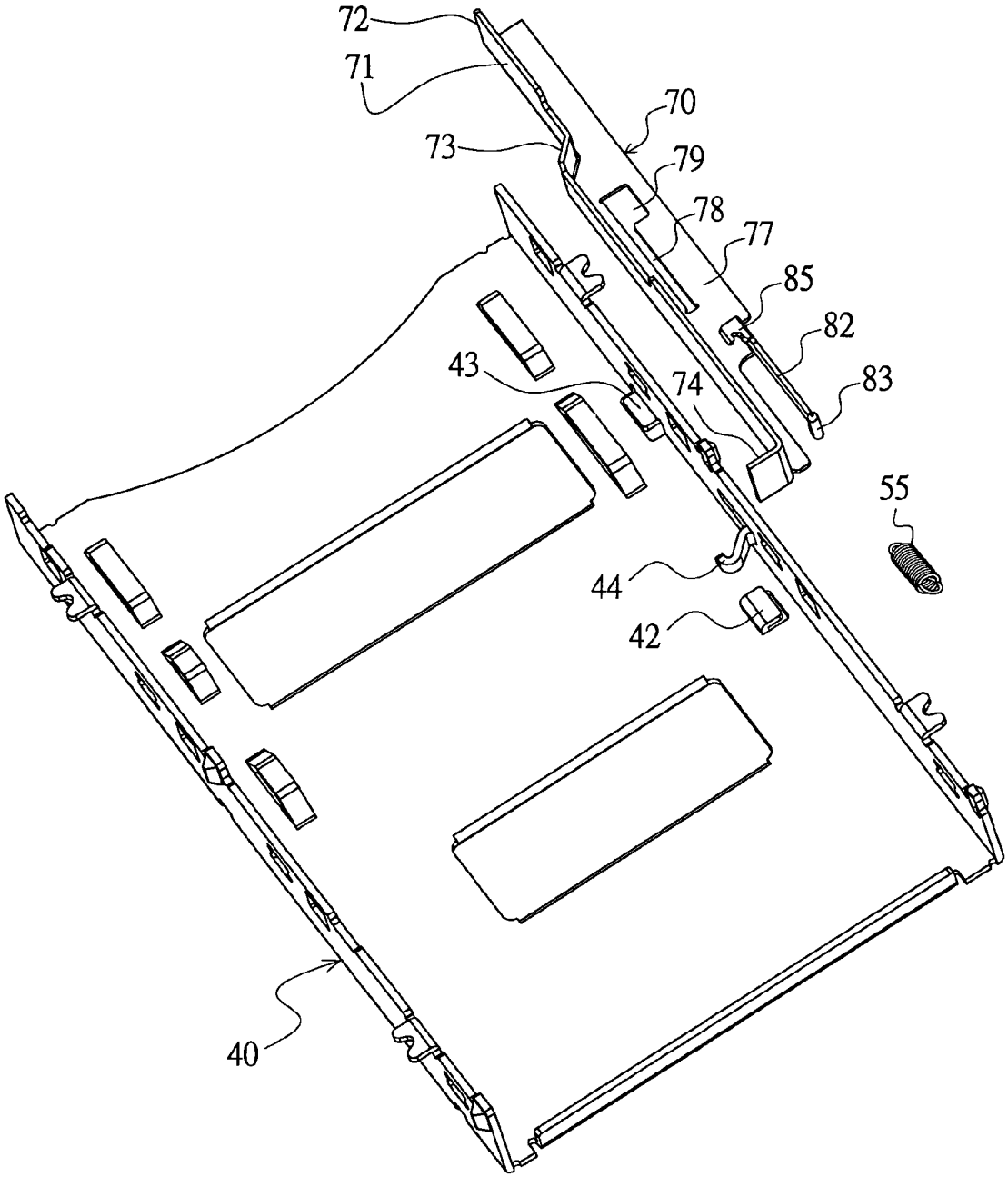
FIG. 10 is a pictorially exploded view showing the upper cover and the pushing piece according to the first embodiment of the invention.
Figure 11:
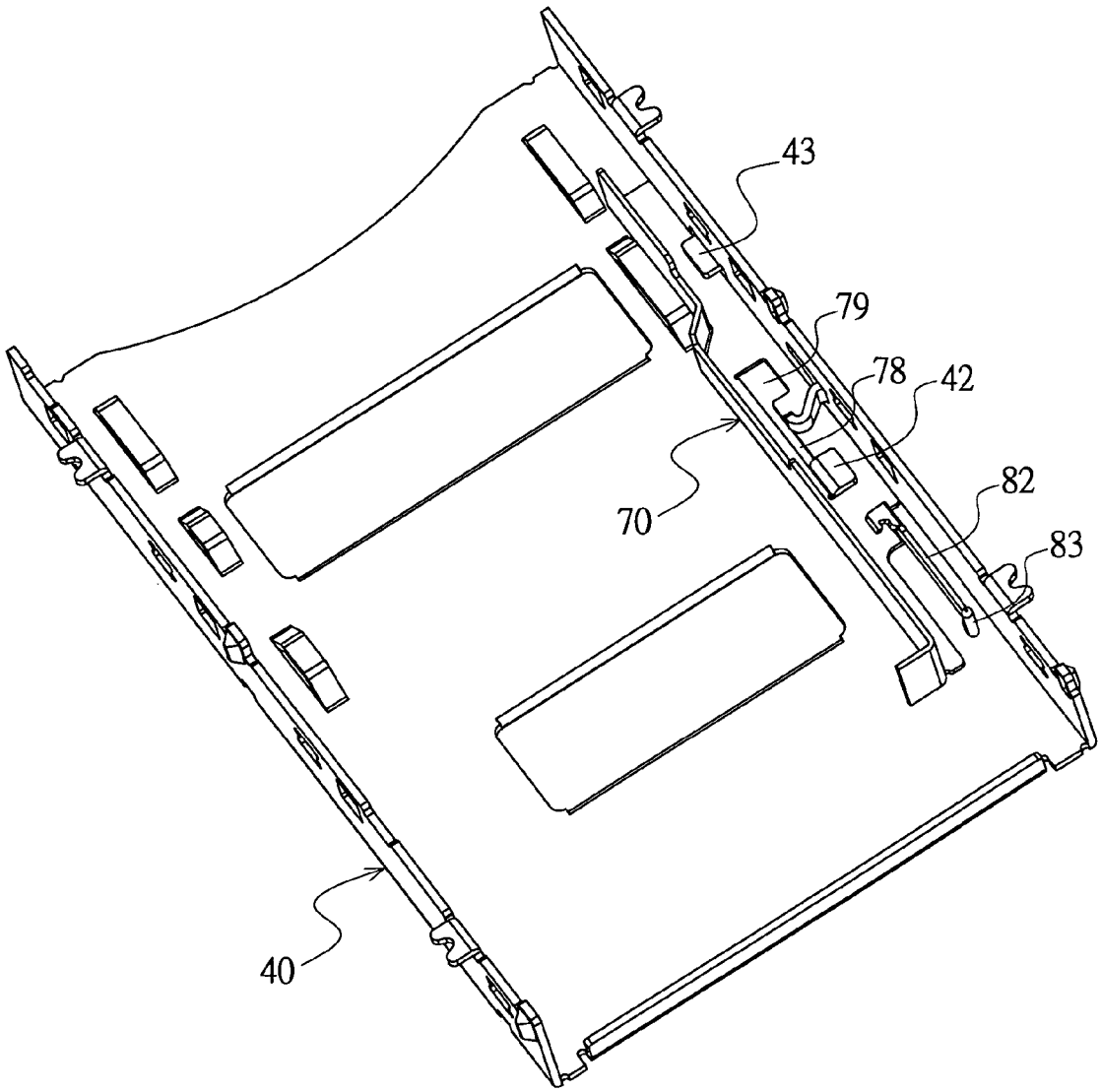
FIG. 11 is a pictorially assembled view showing the upper cover and the pushing piece according to, the first embodiment of the invention.

The base 3 includes a bottom seat 30 and an upper cover 40 covering over the bottom seat 30 such that the front end of the base 3 is formed with an insertion port 36. The bottom seat 30 is composed of three sub-seats 31 with different shapes. Two sides of each sub-seat 31 is formed with two engaging blocks 32, two sides of the upper cover 40 are formed with engagement holes 41 and fitting holes 45 corresponding to the engaging blocks 32 of the sub-seats. Two sides of the sub-seat 31 are formed with engaging blocks 32 to be engaged with the engagement holes 41 at two sides of the upper cover 40. Another engaging block 32 is fit with the fitting hole 45 such that the sub-seat 31 may be moved relative to the upper cover 40. The bottom seat 30 is formed with a receiving slot 33 into which various memory cards with different specifications may be inserted. One side of the sub-seat 31 at the rear end is formed with a disposing slot 34. In addition, the inner surface of the upper cover 40 is formed with a hook body 44 and a first engaging piece 42 and a second engaging piece 43 both having an L shape, as shown in FIGS. 10 and 11.

The terminals 50 are disposed on the three sub-seats 31 and may be adjusted such that the pins of the terminals on the three sub-seats 31 are located on the same plane because the three sub-seats 31 can be moved vertically relative to the upper cover 40.

As shown in FIGS. 6 to 9, the metal sliding slot structure 60 is positioned in the disposing slot 34 of the bottom seat 30 and formed integrally by pressing a metal plate. The metal sliding slot structure 60 includes a bottom seat 61, an internal track plate 65, an external track plate 610 and several one-way stoppers 68.

The rear wall of the disposing slot 34 is formed with a slot 35, two sides of the front end of the disposing slot 34 are formed with engagement surfaces 36, and the bottom surface of the disposing slot 34 is formed with a projection 37.

The rear end of the bottom seat 61 is formed with a slantingly elastic engaging piece 62.

The internal track plate 65 is formed by tearing the bottom seat 61 from one side and bending the bottom seat 61 by a height such that the internal track plate 65 is horizontal and located above the bottom seat 61, and the bottom seat 61 is formed with a notch 63. One end of the internal track plate 65 is a tip 66, and the other end thereof has a substantial M-shape to form a concave first positioning point 67.

The external track plate 610 is formed by bending the other side of the bottom seat 61 by a height and is then horizontally located above the bottom seat 61. The external track plate 610 is formed with an opening 611 for enclosing the internal track plate 65. A circulation path 69 is formed between the internal and external track plates 65 and 610. One end of the opening 611 of the external track plate corresponds to the tip 66 of the internal track plate 65 to form a second positioning point 612. The other end of the opening 611 has a substantial M-shape corresponding to the substantial M-shape at the one end of the internal track plate 65, such that the end is formed with a middle convex portion and two concave portions. The two concave portions are a stroke point 613 and a card-out starting point 614, respectively.

The one-way stoppers 68 protruding from the bottom seat 61 are formed by pressing the bottom seat 61 such that the circulation path 69 goes from the second positioning point 612 to the stroke point 613, the first positioning point 67, the card-out starting point 614 and then to the second positioning point 612 to form a one-way circulation.

In assembly, the front end of the external track plate 610 of the metal sliding slot structure 60 is first inserted into the disposing slot 34 such that the front end of the external track plate 610 is located under the engagement surface 36. The notch 63 of the bottom seat 61 is aligned with the projection 37. Next, the bottom seat 61 is pressed down such that the engaging piece 62 at the rear end of the bottom seat 61 engages with the slot 35. Thus, the metal sliding slot structure 60 can be firmly positioned in the disposing slot 34 of the bottom seat, and the projection 37 can be filled into the notch 63 of the bottom seat.

Figure 12:
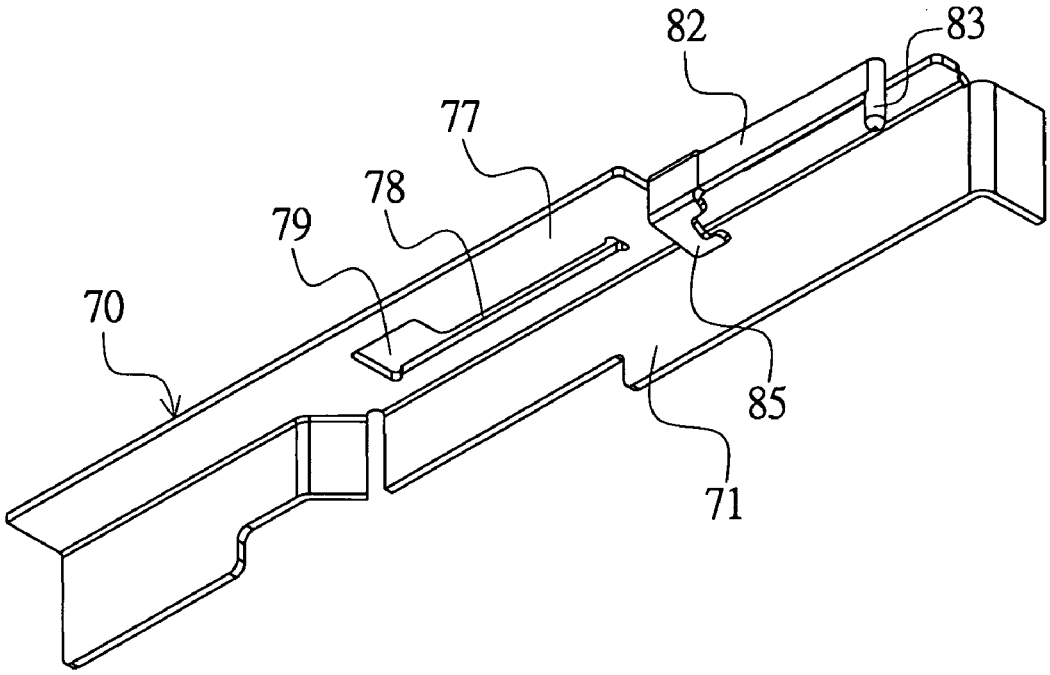
FIG. 12 is a pictorial view showing the pushing piece according to the first embodiment of the invention.

Referring to FIGS. 10 to 12, the pushing piece 70, which is positioned on the inner surface of the upper cover 40 and may slide back and forth, is integrally formed by pressing and bending a metal plate. The pushing piece 70 includes a longitudinal plate 71, a horizontal plate 77, and a guiding rod 82.

The longitudinal plate 71 extends in an inserting direction of the base and includes first to third push portions 72 to 74. The first push portion 72 is a push surface formed in the thickness direction of the plate at the front end. The second push portion 73 is a push surface formed by a slant surface bent in a direction toward the inside of the base at the middle section. The third push portion 74 is a push surface formed by bending a vertical surface in a direction toward the inside of the base from the rear end. The push portions having different widths/lengths and located at different positions can be pushed by various memory cards having different specifications.

The horizontal plate 77 bent into a horizontal state from the top of the longitudinal plate 71 toward the outer side of the base. The horizontal plate 77 is formed with a sliding opening 78 having a wider inserting portion 79. The first engaging piece 42 of the upper cover 40 may be inserted into and engaged with the sliding opening 78, while the second engaging piece 43 of the upper cover 40 is engaged at another position of the horizontal plate 77. Consequently, as shown in FIG. 11, the pushing piece 70 can be engaged with the inner surface of the upper cover 40 such that the pushing piece 70 can slide back and forth.

The guiding rod 82 is integrally connected with the horizontal plate 77, and is formed by bending a rear end of the horizontal plate 77 downward such that the plate face is longitudinal and the lateral elasticity is obtained. The front end of the guiding rod 82 is formed with a hook body 85, and the distal end of the guiding rod 82 has a wider plate face. The longitudinal plate face is wound into a longitudinal rod 83, which is engaged with the metal sliding slot structure 60 and can move along the circulation path 69.

Two ends of the spring 55 are connected to the hook body 85 of the pushing piece 70 and the, hook body 44 of the upper cover 40, respectively. The spring provides the elastic force for moving the pushing piece 70, which is moved from an original position into the base, back to the original position.

Figure 9:
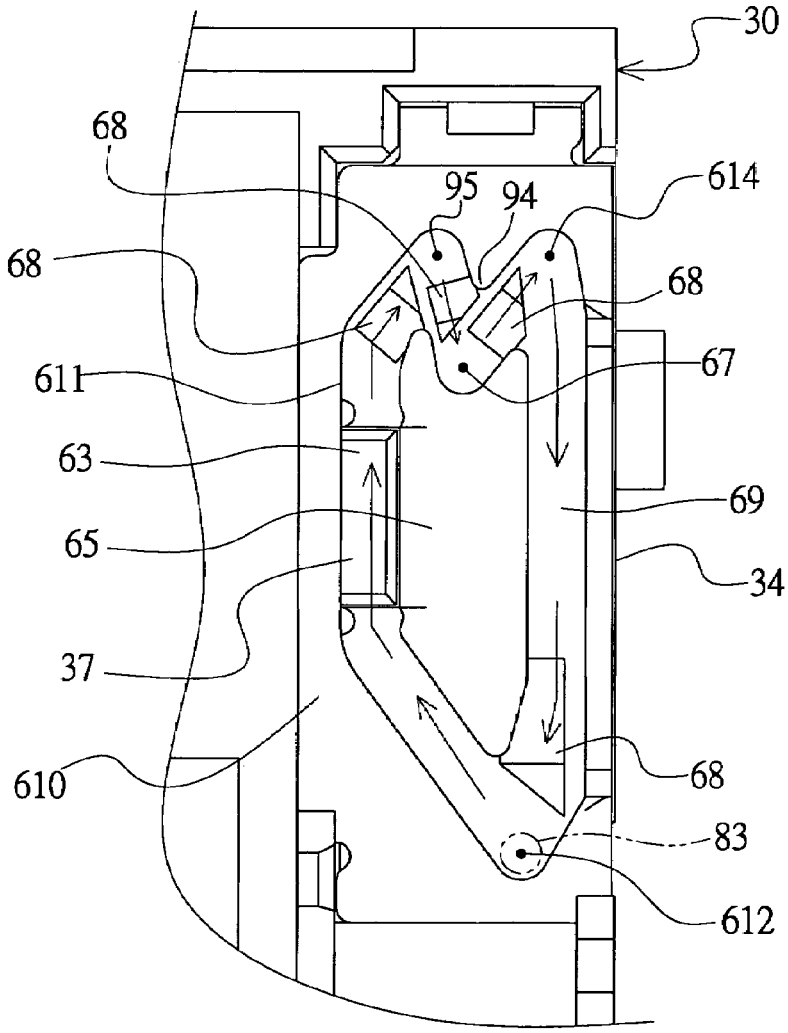
FIG. 9 is a top view showing the metal sliding slot structure and the disposing slot according to the first embodiment of the invention.

As shown in FIG. 9, because the circulation path 69 is the one-way circulation, an inserted memory card pushes the pushing piece 7Q to move the longitudinal rod 83 at one end of the guiding rod 82 from the second positioning point 612 to the stroke point 613. Then, the elastic force of the spring 55 pulls the longitudinal rod 83 back to the first positioning point 67 for positioning. When the card is ejected out, the memory card is also pushed, and the longitudinal rod 83 of the guiding rod 82 is moved from the first positioning point 67 to the card-out starting point 614. Then, the elastic force of the spring 55 pulls the rod 83 back to the initial second positioning point 612, such that the card ejecting function is obtained.

Figure 13:
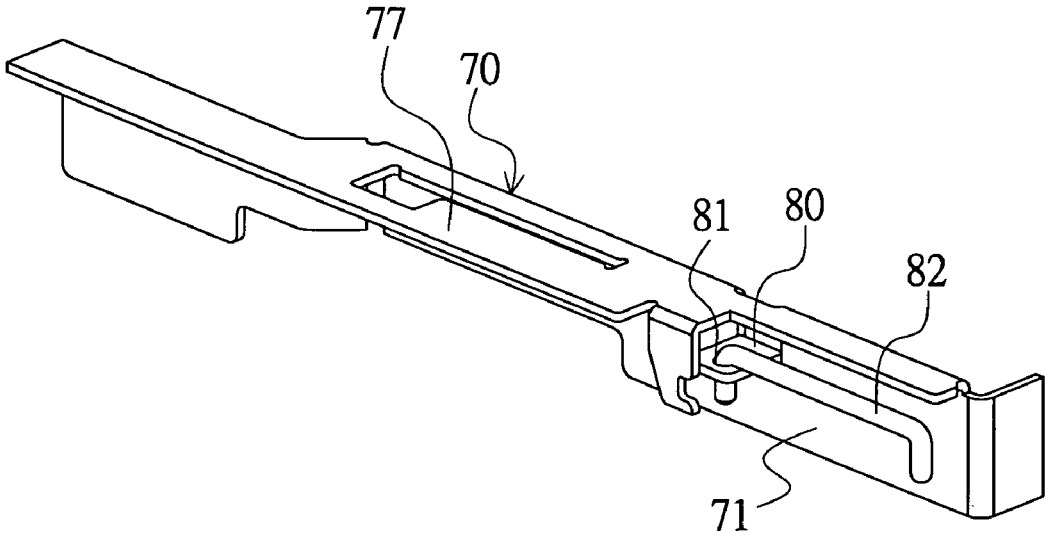
FIG. 13 is a pictorial view showing a pushing piece according to a second embodiment of the invention.

As shown in FIG. 13, the second embodiment of the invention is almost the same as the first embodiment except that the longitudinal plate and the horizontal plate in the second embodiment is integrally formed by bending a metal plate. The guiding rod 82 is formed by bending a metal wire into an inverse U-shape. The longitudinal plate 71 is outwardly pressed to form a horizontal connection plate 80. The connection plate 80 is formed with a connection hole 81, into which one end of the guiding rod 82 is inserted.

Figure 14:
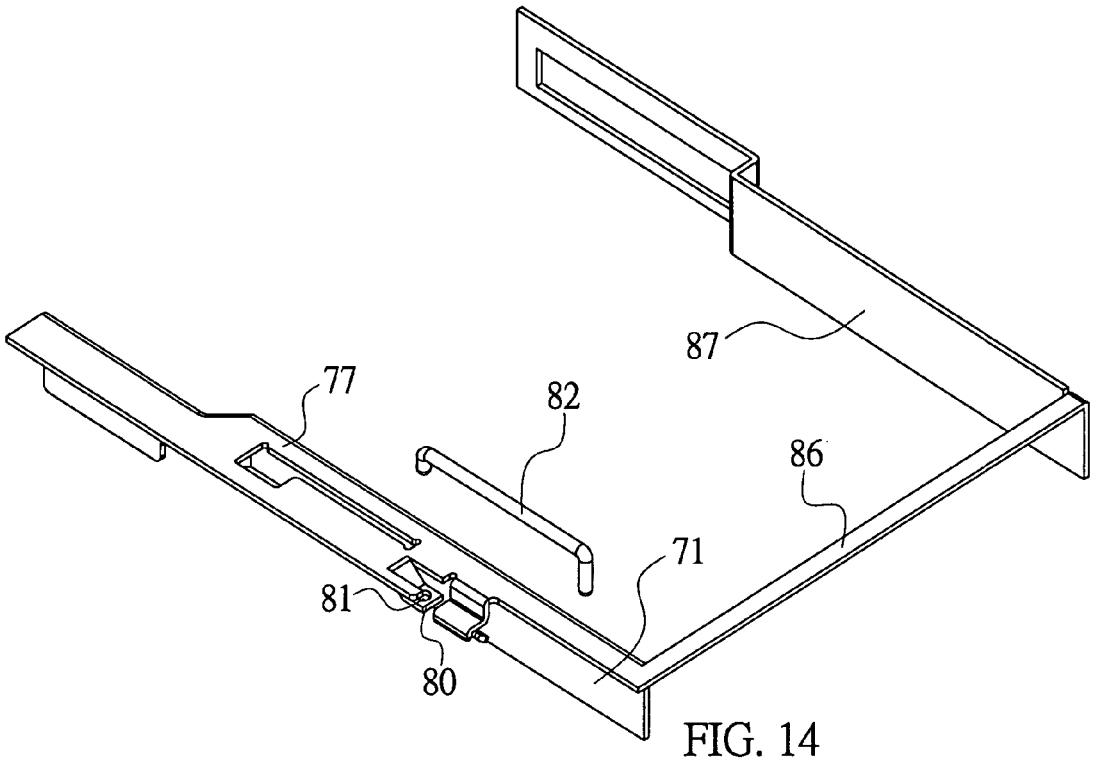
FIG. 14 is a pictorially exploded view showing a pushing piece according to a third embodiment of the invention.
Figure 15:
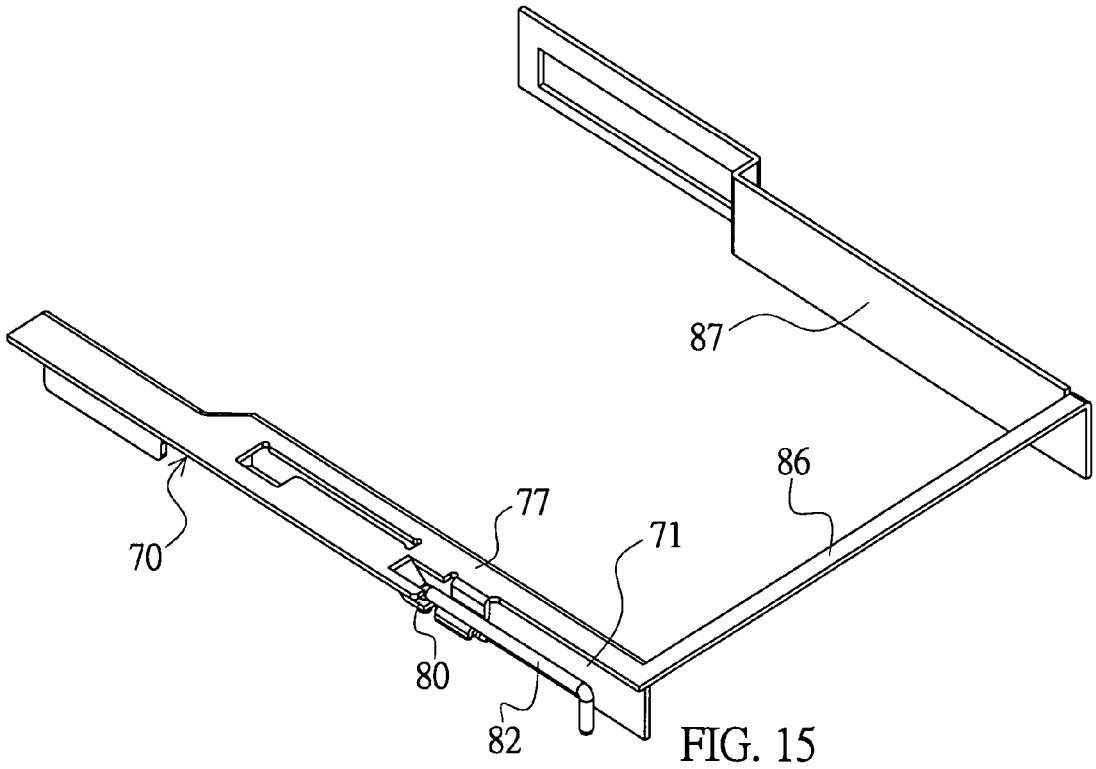
FIG. 15 is a pictorially assembled view showing the pushing piece according to a third embodiment of the invention.

As shown in FIGS. 14 and 15, the third embodiment of the invention is almost the same as the first embodiment except that the front ends of the longitudinal plate 71 and the horizontal plate 77 are integrally connected with one end of a transversal plate 86. The other end of the transversal plate 86 is integrally connected with a second longitudinal plate 87, such that the pushing piece integrally forms an inverse U-shape. In this way, the pushing piece 70 may be placed in the base more stably. In addition, the rear end of the horizontal plate 77 is pressed to form a connection plate 80, which is lower than the horizontal plate 77. The connection plate 80 is formed with a connection hole 81. The guiding rod 82 is formed by bending a metal wire into an inverse-U shape, and one end of the guiding rod 82 is inserted into the connection hole 81.

Figure 16:
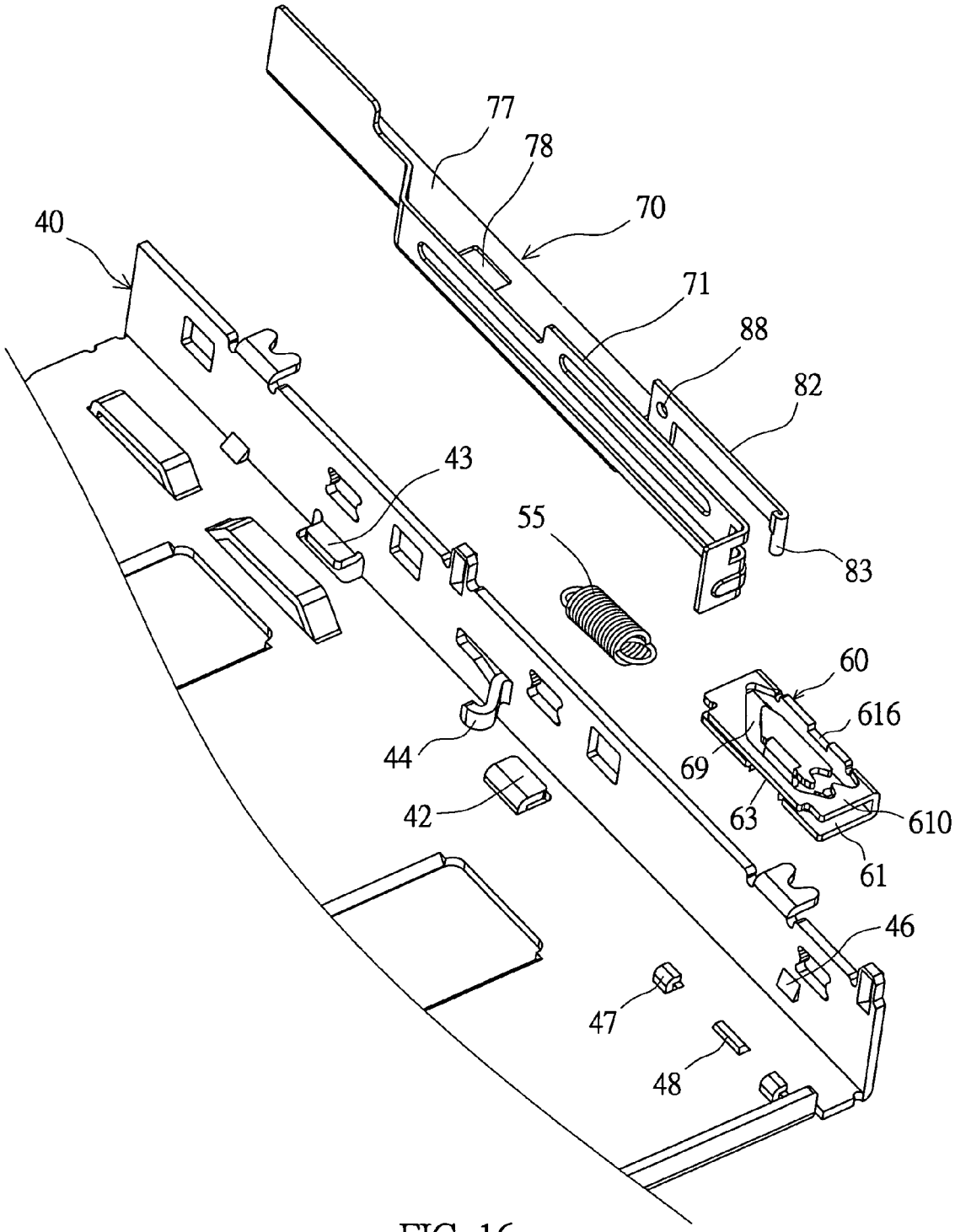
FIG. 16 is a pictorially exploded view showing a card-in/out device according to a fourth embodiment of the invention.
Figure 17:
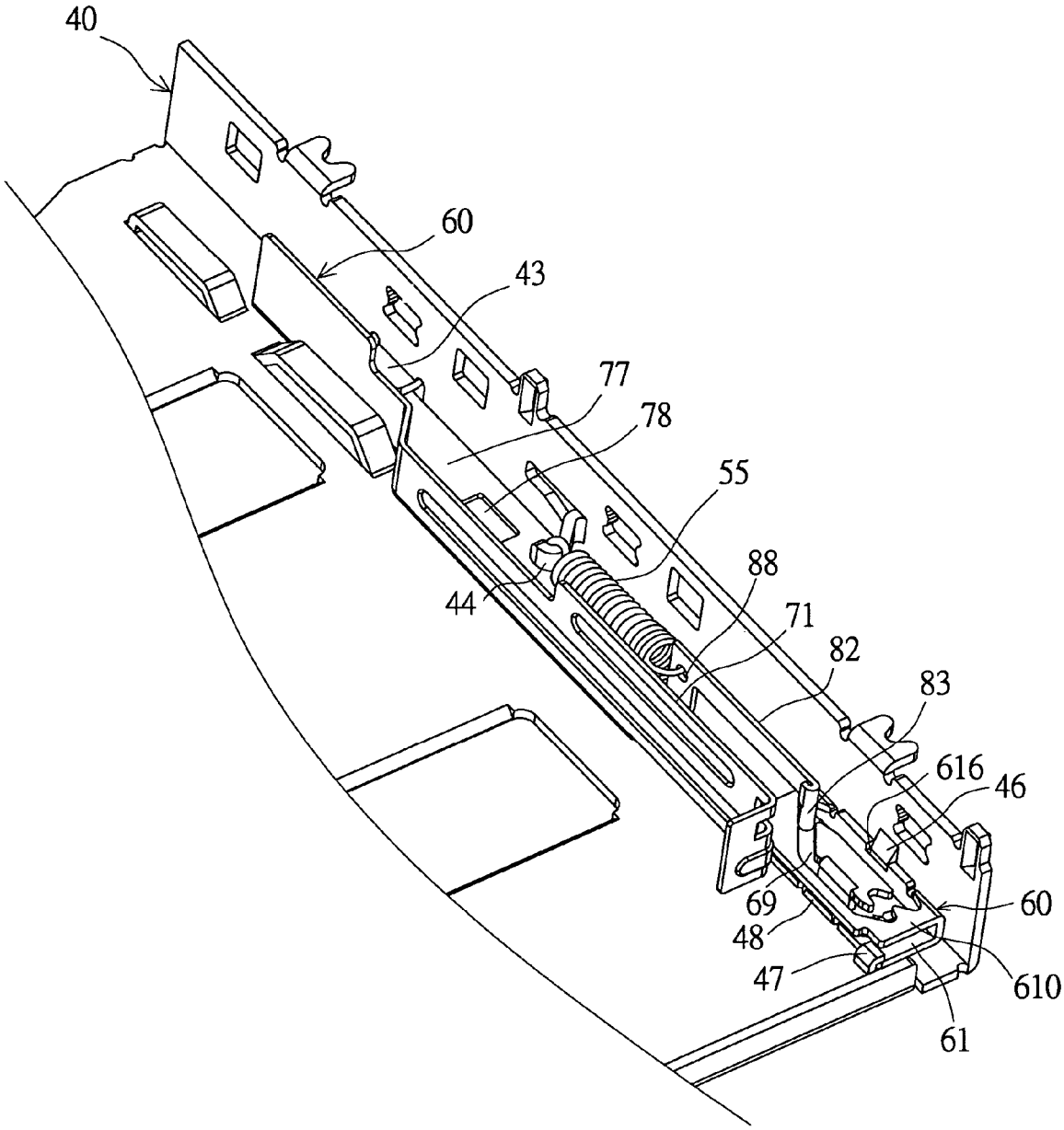
FIG. 17 is a pictorially assembled view showing the card-in/out device according to the fourth embodiment of the invention.

As shown in FIGS. 16 and 17, the fourth embodiment is almost the same as the first embodiment except that the metal sliding slot structure 60 of the fourth embodiment is positioned on the inner surface of the upper cover 40, the inner surface of the upper cover is formed with two hooks 47 and one projection 48, the lateral side of the upper cover 40 is formed with an engaging block 46, and a recess 616 is formed on the top of the outer side of the metal sliding slot structure 60. In assembly, the bottom seat 61 of the metal sliding slot structure 60 engages with the hook 47 and the notch 63 of the bottom surface is pressed down such that the recess 616 is locked under the engaging block 46. The pushing piece 70 and the upper cover 40, which are the same as those of the first embodiment, engage with each other such that the pushing piece 70 may slide back and forth relative to the upper cover 40. One end of the guiding rod 82 of the pushing piece 70 is formed with a longitudinal rod 83, which protrudes toward the upper cover and is inserted into and slide in the circulation path 69 of the metal sliding slot structure 60. The front end of the guiding rod 82 is formed with a hooking hole 88. Two ends of the spring 55 are connected to the hooking hole 88 of the pushing piece 70 and the hook body 44 of the upper cover 40, respectively. The spring 55 provides the elastic force for moving the pushing piece 70, which is moved from an original position into the base, back to the original position.

According to the invention, the metal sliding slot structure 60, the spring 55 and the pushing piece 70 are assembled and positioned on the upper cover 40. Thus, a complete card-in/out mechanism can be formed before the bottom seat 30 is assembled with the upper cover 40. The card-in/out mechanism can be tested in the phase of the semi-facture, which is advantageous to the production.

The invention has the following advantages.

1. The metal sliding slot structure 60, the spring 55 and the pushing piece 70 are assembled and positioned on the upper cover 40. Thus, a complete card-in/out mechanism can be formed when the bottom seat 30 is not assembled with the upper cover 40. The card-in/out mechanism can be test in the phase of the semi-facture, which is advantageous to the production.

2. The pushing piece 70, which is formed by pressing and bending a metal plate, has good structural intensity, and is free from been broken or damaged by the external force.

3. The pushing piece 70, which is not positioned on the bottom seat, can be engaged with the upper cover 40 and moved back and forth. Thus, the bottom seat 30 of the invention can be divided into three sub-seats 31, which can be moved vertically relative to the upper cover 40. Thus, the pins of the terminals 50 of the three sub-seats 31 can be adjusted such that the pins are located on the same plane.

4. The inverse-U-shaped pushing piece 70 can provide a stable pushing force. Because the pushing piece 70 of the invention is formed by pressing and bending a metal plate, the pushing piece 70 cannot be broken easily.

5. The metal sliding slot structure 60, which is formed by pressing and bending a metal plate, has good structural intensity and can withstand the wear. The reliability in usage can be ensured because the condition of damage or sliding cannot be easily caused.

6. The metal sliding slot structure 60 and the pushing piece 70 are made of the metal material, and the intensity of the metal material is higher than that of the plastic material. So, the components 60 and 70 can be made by way of thin plate pressing, and the overall areas thereof are smaller than those made by way of plastic molding. Thus, the product can be miniaturized.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A card-in/out device for an electrical connector, the electrical connector having a base composed of a bottom seat and an upper cover covering over the bottom seat, the card-in/out device comprising:

a sliding slot structure, which is disposed in the base and has a circulation path, one end of the circulation path being formed with a concave first positioning point, the other end of the circulation path being formed with an initial second positioning point, a bottom surface of the sliding slot structure being formed with a plurality of one-way stoppers such that a one-way circulation from the second positioning point to the first positioning point and then to the second positioning point is formed;

a pushing piece, which is disposed in the base and may slide back and forth relative to the upper cover, wherein the pushing piece is formed by pressing and bending a metal plate and comprises:

a longitudinal plate extending in an inserting direction of the base and comprises at least one push portion which may be pushed by an inserted electrical element in the inserting direction;

a horizontal plate integrally connected with the longitudinal plate, the horizontal plate being bent into a horizontal state from a top of the longitudinal plate toward one side; and a guiding rod having one end connected to the horizontal plate or the longitudinal plate, and the other end engaged with the sliding slot structure of the base such that the guiding rod can slide back and forth along the circulation path; and an elastic member for providing an elastic force for moving the pushing piece, which is moved from an original position into the base, back to the original position.

2. The device according to claim 1, wherein the sliding slot structure is a metal sliding slot structure integrally formed by pressing and bending another metal plate.

3. The device according to claim 1, wherein an inner surface of the upper cover is formed with at least one L-shaped engaging piece, the horizontal plate of the pushing piece is formed with a sliding opening, the sliding opening has a wider inserting portion, such that the at least one L-shaped engaging piece of the upper cover may be fit into the sliding opening and may slide back and forth.

4. The device according to claim 1, wherein front ends of the longitudinal plate and the horizontal plate of the pushing piece are integrally connected with one end of a transversal plate, and the other end of the transversal plate is integrally connected with a second longitudinal plate, such that the pushing piece integrally forms an inverse U-shape.

5. The device according to claim 1, wherein the longitudinal plate is pressed outwards to form a horizontal connection plate formed with a connection hole, and one end of the guiding rod is bent into a longitudinal portion fit into the connection hole.

6. The device according to claim 1, wherein a rear end and a middle section of the longitudinal plate are bent to form the at least one push portion, and a front end of the longitudinal plate forms the at least one push portion in a thickness direction.

7. The device according to claim 1, wherein the sliding slot structure is fixed to an inner surface of the upper cover.

8. The device according to claim 7, wherein the sliding slot structure is a metal sliding slot structure, which is integrally formed by pressing and bending another metal plate, a recess is formed on a top of an outer side of the metal sliding slot structure, the inner surface of the upper cover is formed with at least one hook for locking the bottom surface of the metal sliding slot structure, and a lateral side of the upper cover is formed with an engaging block for engaging with the recess of the metal sliding slot structure.

* * * * *